United States Patent [19]

Ramsay

[11] Patent Number: 4,682,430

[45] Date of Patent: Jul. 28, 1987

[54] PRICE CHIP SUPPORT STRIP

[75] Inventor: Charles F. Ramsay, Knoxville, Tenn.

[73] Assignee: Plasti-Line, Inc., Knoxville, Tenn.

[21] Appl. No.: 844,672

[22] Filed: Mar. 27, 1986

[51] Int. Cl.[4] ..... G09F 3/20

[52] U.S. Cl. ..... 40/5; 40/10 R; 40/490; 40/576; 40/618

[58] Field of Search ..... 40/618, 5, 10 R, 488, 40/489, 490, 491, 158 B, 576, 575

[56] References Cited

U.S. PATENT DOCUMENTS

| | | | |
|---|---|---|---|
| 148,844 | 3/1874 | Parsons | 40/576 |
| 829,951 | 9/1906 | Dawes | 40/576 |
| 1,120,876 | 12/1914 | Witz | 40/576 |
| 1,188,282 | 6/1916 | Larson | 40/576 |
| 1,991,673 | 2/1935 | Horne | 40/5 |
| 2,106,375 | 1/1938 | Hemry | 40/618 |
| 2,276,735 | 3/1942 | Miller | 40/158 B |
| 3,148,469 | 9/1964 | Umanoff | 40/5 |
| 3,371,439 | 3/1968 | Smith et al. | 40/154 |
| 3,458,944 | 8/1969 | Jimenez | 40/618 |
| 3,753,306 | 3/1973 | Hemgren | 40/618 |
| 4,593,486 | 6/1986 | Visocky et al. | 40/5 |

FOREIGN PATENT DOCUMENTS

| | | | |
|---|---|---|---|
| 397163 | 2/1909 | France | 40/576 |
| 90520 | 10/1957 | Norway | 40/5 |
| 365277 | 12/1962 | Switzerland | 40/618 |
| 596707 | 1/1948 | United Kingdom | 40/618 |
| 958595 | 5/1964 | United Kingdom | 40/618 |

*Primary Examiner*—Robert P. Swiatek
*Assistant Examiner*—J. Hakomaki
*Attorney, Agent, or Firm*—Brady, O'Boyle & Gates

[57] ABSTRACT

A price chip support strip of simplified construction has positive engagement with guide and retention tracks of a strip support frame. Individual price chips are conveniently removed and inserted at the front of the price chip support strip. An effective light seal is assured by the structure.

7 Claims, 8 Drawing Figures

PRICE CHIP SUPPORT STRIP

BACKGROUND OF THE INVENTION

The present invention relates to signs and more particularly relates to an improved price chip support strip or holder of the type utilized in menu and price display structures in fast food restaurants.

A major object of the present invention is to provide a price chip support strip of greater simplicity which will allow the individual price chips bearing numerals to be inserted in and removed from the support strip by personnel facing the front of the support strip. This is a major advantage over certain prior art price chip support strips where it is necessary to install and remove the chips from the rear of the support strip instead of the front thereof. The personnel commonly employed by fast food restaurants and the like are youthful extremely low skill personnel, prone to making mistakes. Therefore, the requirement for rearranging menu article price strips at the rear of the support strip leads to frequent errors in the locating of the price chips along the support strip. In accordance with the present invention where the price chips are manipulated at the front of the support strip, there is much less chance for errors to occur in the arrangement of the pricing indicia, even when the least skilled workers are involved. This is true to a great extent because, in the present invention, the pricing numerals can be read in a normal manner at the front of the support strip, in contrast to the necessity for reading them reversely at the rear of the strip in some prior art structures.

Another object of the invention is to provide a support strip for price chips in which the chips are positively retained in individual pockets provided in the support strip while being conveniently removable from the pockets at the front of the support strip.

Another object of the invention is to provide a price chip support strip having means to assure its retention without play in the guide tracks of a strip support frame.

Still another object of the invention is to provide a price chip support structure having improved light sealing capability.

Other features and advantages of the invention will become apparent to those skilled in the art during the course of the following detailed description.

DETAILED DESCRIPTION

Figure 1:
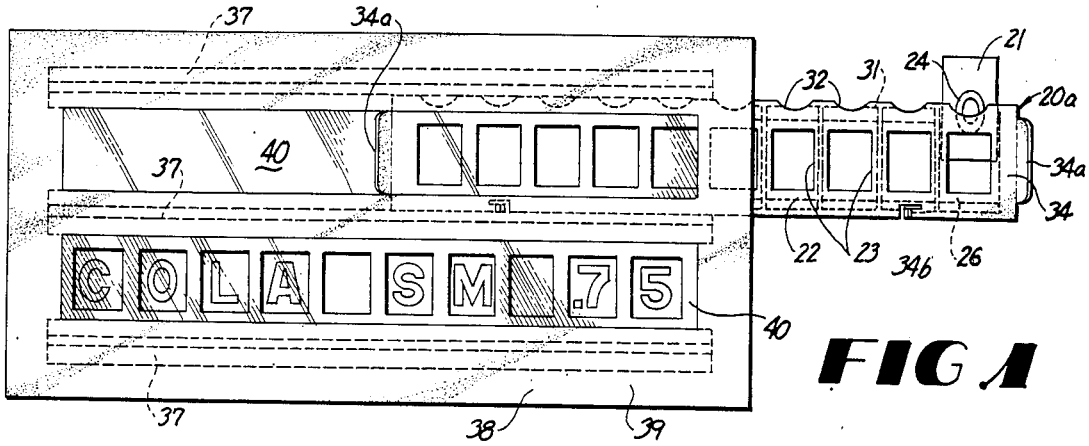
FIG. 1 is a front elevation of a price chip support strip according to the present invention in conjunction with a strip support frame.
Figure 2:
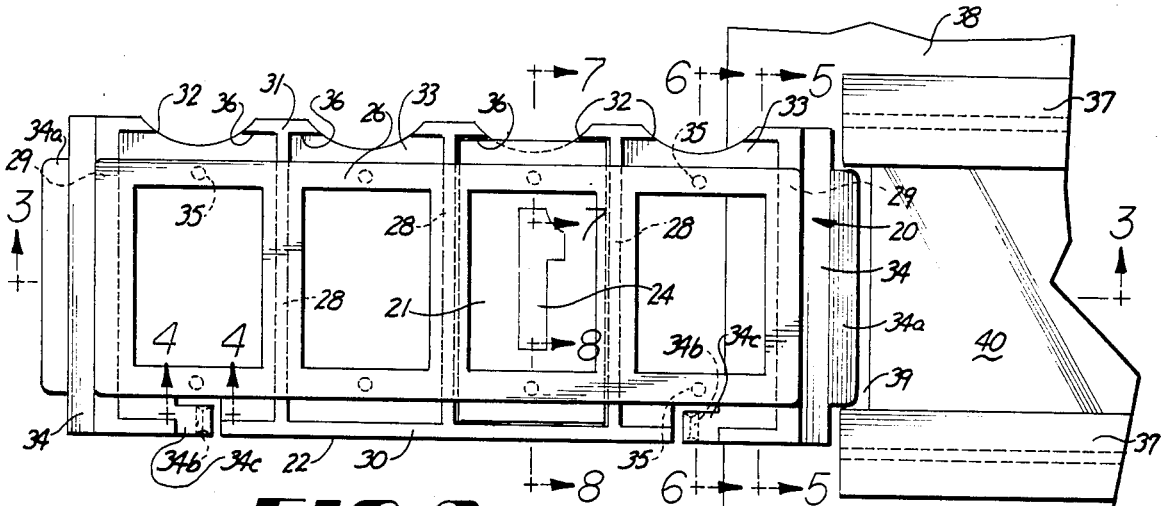
FIG. 2 is a rear elevation of a price chip support strip according to the invention.
Figure 3:
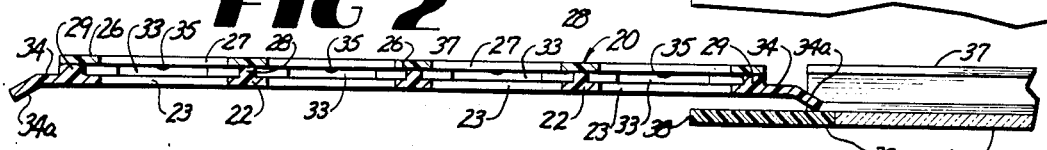
FIG. 3 is an enlarged horizontal longitudinal section taken on line 3—3 of FIG. 2.
Figure 4:
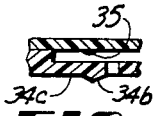
FIG. 4 is an enlarged fragmentary horizontal section taken on line 4—4 of FIG. 2.

Referring to the drawings in detail wherein like numerals designate like parts, a price chip support strip 20 according to the present invention may be constructed to accommodate four price chips 21, FIG. 2, or, as shown in FIG. 1, the support strip 20*a* may be constructed to accommodate ten of the chips 21. In fact, the support strip may be constructed to hold any practical number of the price chips. Except for the different numbers of price chips held in the support strips 20 and 20*a*, the two strips are identical in construction, and therefore a detailed description of the support strip 20 will also serve to describe the strip 20*a*.

The price chip support strip 20 is unitary and preferably formed of plastics. It is elongated and substantially rectangular. It includes a flat front face panel portion 22 provided with a required number of rectangular equal size display openings 23 for the numeric indicia 24 of the price chips 21. The strip 20 further comprises a rear panel 26 suitably secured to the rear of front portion 22 and being provided with rectangular openings 27 of the same size and shape as the openings 23 and being in registration with the latter.

Parallel ribs 28 are formed on the rear side of front portion 22 and somewhat wider ribs 29 are formed on the front portion 22 at its ends. All of the ribs 28 and 29 project rearwardly equidistantly and maintain the front portion 22 and the rear panel 26 in spaced parallel relationship.

Figure 7:
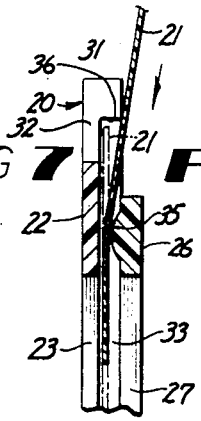
FIG. 7 is an enlarged fragmentary vertical section taken on line 7—7 of FIG. 2 depicting the installation of a price chip into a pocket of the support strip.
Figure 8:
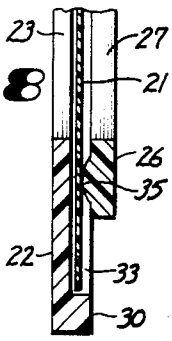
FIG. 8 is a similar section taken on line 8—8 of FIG. 2.

At its bottom and top longitudinal edges, the front portion 22 of the support strip 20 has longitudinal ledges 30 and 31 formed thereon integrally at right angles to the ribs 28 and 29. The top ledges 31 are interrupted by arcuate finger grip recesses 32, as shown in the drawings. The ledges 30 and 31 project rearwardly the same distance as the ribs 28 and 29 and define with the latter rectangular pockets 33 for the price chips 21 between the front portion 22 and the rear panel 26 of the support strip 20. The rear panel 26 is of lesser height than the front portion 22 and the top and bottom edges of the rear panel 26 are spaced equidistantly from the corresponding edges of the forward portion 22 in parallel relationship therewith, FIG. 2. This arrangement allows the tops of the price chip receptor pockets 33 to be opened or exposed at their rears, FIGS. 2 and 7, to facilitate the installation and removal of the flexible plastics price chips 21, as will be further described.

At its opposite ends, the front portion 22 carries integral extensions 34 extending from top-to-bottom thereof. These extensions on their vertical edges carry forwardly canted light sealing blades 34*a* whose vertical edges project slightly forwardly of the frontal flat face of front panel portion 22. Additionally, a pair of small forwardly projecting locator lugs 34*b* are provided adjacent to the bottom longitudinal edge of the front portion 22, and preferably at the centers of the two endmost rectangular openings 27 in the case of the shorter chip support strip 20. On the longer support strip 20*a*, the two locator lugs 34*b* are preferably provided on the front portion of the strip at its lower longitudinal edge at the centers of the display openings 23 which are next to the two endmost display openings. In either strip 20 or 20*a*, the locator lugs 34*b* could be placed anywhere between the two ends of the strip. Preferably, the locator lugs 34*b* are held on small leaf spring portions 34*c* formed integrally with the front portion 22.

Small rounded projections 35 are provided on the front face of the rear panel 26 adjacent to the top and bottom longitudinal edges thereof and between the rear panel 26 and the opposing face of the front portion 22 of the support strip 20. The function of the projections 35 is to substantially engage or slightly grip the rear face of the price chip 21 within the pocket 33 and maintain the price chip substantially against the rear face of the forward portion 22 of the price chip support strip without appreciable play. This feature, plus the action of the marginal edges of the rectangular pockets 33 on the price chip 21, assures its retention in the pocket 33 with stability until such time when it becomes necessary to remove the price chip from the support strip 20.

When this becomes necessary, the price chip 21 is easily removed by positive action exercised by anyone stationed forwardly of the support strip 20. Such a person need merely grasp the top edge of any particular chip 21 with the fingers in one of the finger grip recesses 32, bend the top of the chip rearwardly to clear the top retention shoulder 36, FIG. 7, defined by the ledge 31, and simultaneously pull the chip 21 upwardly to extract it from the pocket 33. During the reverse procedure of installing a price chip 21 in one of the pockets 33, the top edge of the chip will snap under the retention shoulder 36 and be retained thereby in the pocket 33, as shown in broken lines in FIG. 7. As stated, all of this activity can be carried out by an attendant in front of the support strip 20 instead of at the rear thereof, as is sometimes required in the prior art.

The price chip support strip 20 forming the main subject matter of the present invention is received horizontally in support and guide tracks 37 of H-cross section, secured to the rear face of a transparent frame panel 38 having an opaque mask 39 on its forward face defining elongated clear window panels 40 for the display of the price chip indicia therethrough, FIG. 1.

Figure 5:
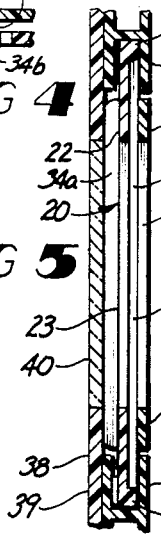
FIG. 5 is an enlarged vertical section taken on line 5—5 of FIG. 2, also showing the strip support frame and guide tracks in cross section.
Figure 6:
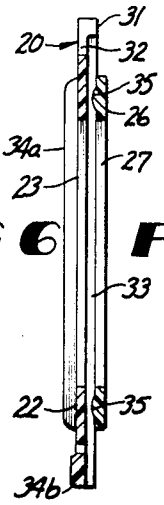
FIG. 6 is a similar section taken on line 6—6 of FIG. 2.

The support strip 20 is received slidably in the tracks 37, FIG. 5, and the frontal locator lugs **34*b* engage the opposing track faces and take up any slack in the track channels by causing the rear ledges 30 and 31 to substantially engage the rear faces of the tracks 37. Thus, there is little or no front-to-back play between the strip 20 and track 37**.

The rear panel 26 of support strip 20 engages closely between the upper and lower tracks 37, as best shown in FIG. 5. This adds to the stability and ease of insertion and removal of the support strip. Additionally, the construction of the improved price chip support strip and its support frame having tracks 37 and masked panel 38 provides an excellent light seal, so that light from any illuminating means behind the sign is visible only through the transparent areas of the otherwise opaque chips 21 defining the chip indicia 24. The blades **34*a* prevent light from entering the structure at the two ends of the strip 20 or 20*a*, and the free edges of the blades 34*a* substantially contact the opposing faces of the panel 38**.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A utilized elongated substantially rigid support strip for price chips or the like comprising, a front panel portion which is elongated and substantially rectangular and provided along its length with a plurality of equidistantly spaced equal size price chip display openings, the front panel portion having a substantially flat front face and being provided on its rear side with a plurality of top-to-bottom extending spaced parallel ribs of equal thickness rearwardly of the front panel portion, said ribs being disposed on opposite sides of said price strip display openings, said front panel portion being further provided in its rear side with a pair of parallel longitudinal ledges of the same thickness as said ribs rearwardly of the front panel section, said ledges defining top and bottom longitudinal edges of the front panel portion, a rear elongated flat substantially rectangular panel portion which is substantially coextensive lengthwise with the front panel portion and engaging the rear faces of said ribs and extending across the ribs, the rear panel portion having display openings corresponding in number, size and spacing with the display openings of the front panel portion and being in substantial registration therewith, the rear panel portion being of lesser height than the front panel portion and having top and bottom longitudinal parallel edges spaced respectively below and above the corresponding longitudinal edges of the front panel portion in parallel relationship thereto and below and above said ledges of the front panel portion, the front and rear panel portions defining rectangular price chip pockets within the support strip between said ribs and ledges, the front panal portion having finger recesses in its top longitudinal edge with one such recess adjacent to the top portion of each price chip pocket, whereby the upward removal of each price chip from its pocket is facilitated, and pairs of projections formed on the front face of the rear panel portion above and below said display openings and being engageable with price chips being held in said pockets to position the price chips normally against the rear of the front panel portion and within the margins of said pockets which are defined by said ribs and ledges.

2. A unitized elongated substantially rigid support strip for price chips or the like as defined in claim 1, and support strip locator projections on said front panel portion extending somewhat forwardly thereof, whereby the support strip can be engaged snugly in a horizontal trackway.

3. A unitized elongated substantially rigid support strip for price chips or the like as defined in claim 2, and said support strip locator projections being carried out by leaf spring elements of the front panel portion near the bottom and near the opposite ends thereof.

4. A unitized elongated substantially rigid support strip for price chips or the like as defined in claim 3, and top-to-bottom extending forwardly canted light sealing blades on the opposite ends of said front panel portion.

5. A unitized support strip for rectangular price chips or the like comprising, united front and rear elongated panel portions in spaced parallel substantially longitudinally coextensive relationship, said front and rear display panel portions having substanially registering price chip display openings formed therethrough, said rear panel portion being of lesser height than the front panel portion and having top and bottom longitudinal edges parallel to and spaced below and above corresponding longitudinal edges of the front panel portion, the front panel portion being provided in its top longitudinal edge with finger recesses above the top edge of the rear panel portion, top-to-bottom parallel spacing ribs of equal thickness between the front and rear panel portions and between the price chip display openings thereof, top and bottom parallel longitudinal ledges on the rear of the front panel portion and being of equal thickness with said ribs and being joined with said ribs to form the margins of rectangular price chip pockets adjacent to said price chip display openings, said finger recesses being disposed near and above open tops of said price chip pockets to facilitate upward withdrawal of price chips from the pockets, frontal rounded projections on the rear panel portion above and below the price chip display openings near the lateral centers thereof and being engageable with price chips in said pockets to position the same normally substantially against the rear face of the front panel portion and within the marginal confines of said pockets defined by said ribs and ledges, and the rear panel portion projecting somewhat rearwardly of said ledges and ribs so as to be engageable between track elements of a supporting trackway for the support strip when the parts of the forward panel portion of the support strip are engaging slidably in the track elements of said trackway.

6. A unitized support strip for rectangular price chips or the like as defined in claim 5, and locator elements on the support strip adjacent to one longitudinal edge thereof and being engageable with a trackway surface to maintain the support strip engaged with the trackway substantially without front-to-back clearance or play.

7. A unitized support strip for rectangular price chips or the like as defined in claim 6, and light sealing blades on the opposite ends of said support strip engageable with an opposing surface of a trackway.

* * * * *